United States Patent [19]

Wätterbäck

[11] 4,381,710

[45] May 3, 1983

[54] MOISTURE ACTUATED TRIGGER DEVICE

[75] Inventor: Paul G. Wätterbäck, Flen, Sweden

[73] Assignee: AB Sibe International, Spanga, Sweden

[21] Appl. No.: 193,108

[22] Filed: Oct. 2, 1980

Related U.S. Application Data

[62] Division of Ser. No. 185,927, Sep. 10, 1980.

[51] Int. Cl.[3] ..... F42C 19/00

[52] U.S. Cl. ..... 102/200

[58] Field of Search ..... 102/200, 204, 223, 230, 102/263, 275.6, 275.11; 137/68 R, 68 A, 400; 200/61.04

[56] References Cited

U.S. PATENT DOCUMENTS

| | | | |
|---|---|---|---|
| 414,662 | 11/1889 | Tirmann et al. | 102/204 |
| 1,232,814 | 7/1917 | Kruk | 102/204 |
| 2,432,367 | 12/1947 | Andresen | 200/61.04 |
| 3,013,571 | 12/1961 | Fulton | 137/68 A |
| 4,153,846 | 5/1979 | Watterback | 200/61.04 |

*Primary Examiner*—Charles T. Jordan

*Attorney, Agent, or Firm*—Cushman, Darby & Cushman

[57] ABSTRACT

A moisture actuated trigger device comprising a housing; a moisture absorbing swelling body in said housing, one end of said body engaging a stationary wall of said housing and the opposite end engaging an end wall of a sleeve slidable within said housing upon expansion of the swelling body; an elongated plunger member in said housing movable between a first, stand-by position and a second, released position; latch means detachably engaging said plunger member for holding in its first, stand-by position; a spring means biasing said plunger member in a direction towards its released position, cam means on said sleeve for disengaging the latch means from the plunger member thereby enabling the latter to rapidly move from its first, stand-by position to its released position; and a shock wave initiating means located in the path of said plunger member and adapted to initiate a shock wave when struck by the plunger member.

5 Claims, 2 Drawing Figures

MOISTURE ACTUATED TRIGGER DEVICE

This is a division of my copending application Ser. No. 185,927, filed on Sept. 10, 1980.

The present invention relates to a moisture actuated trigger or igniter device which is adapted to actuate a remote valve, in particular a gas pressure actuated safety valve of the kind as disclosed in my copending U.S. patent application No. 185,927.

The primary object of the present invention is to provide a trigger or igniter device which without need of a supply or a source of electric current is capable of detecting presence of moisture or liquid and in response thereto rapidly activate a shock wave initiating means so as to transfer to the remotely located valve a shock wave for opening or closing of the valve.

The trigger device according to the invention comprises a housing; a moisture absorbing swelling body inserted through an opening in said housing, one end of said body engaging a stationary wall member of said housing and the opposite end engaging an end wall of a sleeve slidable within said housing upon expansion of the swelling body; an elongated plunger member in said housing movable between a first, stand-by position and a second, released position; latch means detachably engaging said plunger m for holding it in its first, stand-by position; spring means biasing said plunger member in a direction towards its released position; cam means on said sleeve for disengaging the latch means from the plunger member thereby enabling the latter to rapidly move from its first, stand-by position to its second, released position; and a shock wave initiating means located in the path of travel of said plunger member.

Such a moisture actuated trigger device according to the invention is particularly suitable for use with a remote emergency shut-off valve in a pipe system, for example in a water supply conduit leading to a household machine, such as a dishwasher. The trigger device is placed below the machine and is adapted to detect presence of water deriving from a leak downstream of the valve and thereby allowing the swelling body to release a spring percussion igniter mechanism of the trigger device so as to detonate the shock wave initiating means which immediately transfers a shock wave through a quick-burning shock-wave generating fuse tube to the valve so as to displace the valve body thereof to its valve seat closing position.

Other features and advantages of the invention will be evident from the following detailed description of a suitable embodiment with reference to the accompanying drawings, in which.

Figure 1:
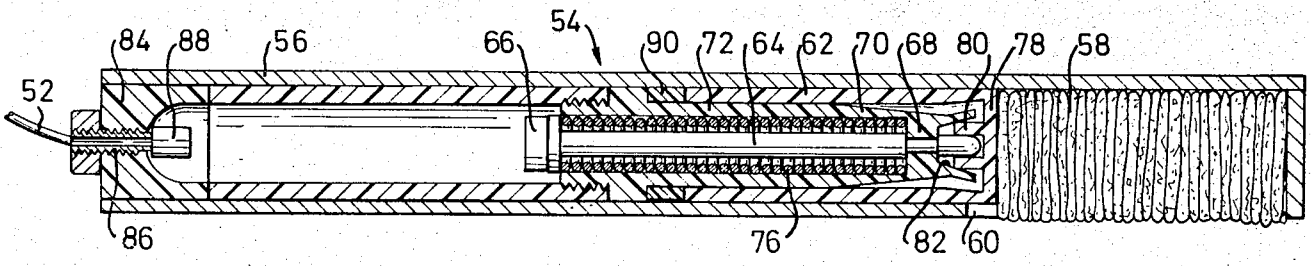
FIG. 1 is a cross-sectional view of a moisture actuated trigger device in a secured stand-by position.
Figure 2:
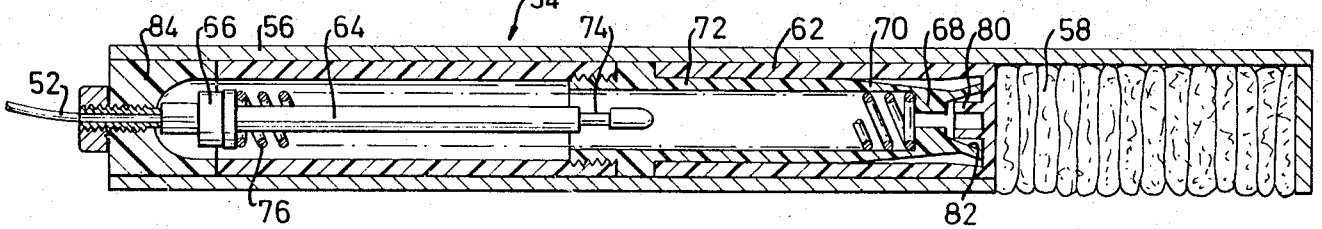
FIG. 2 is a cross-sectional view of the trigger device in FIG. 1 in a released condition.

In FIGS. 1 and 2 the moisture actuated trigger device of the present invention is generally denoted by numeral 54. The trigger device 54 comprises a housing 56 receiving at one end thereof a moisture absorbing swelling body 58, e.g. folded paper material, that may come into contact with leaking water through a lower opening 60 in the housing 56. One end of the swelling body 58 engages a sleeve-shaped, displaceable rear piece 62 of the spring percussion igniter mechanism. The spring percussion igniter mechanism comprises a central plunger 64 having a head 66 at its forward end. In its withdrawn position in FIG. 1 the plunger 64 is adapted to be held by inwardly extending lugs 68 formed on rearwardly extending and inwardly biased leg portions 70 of a sleeve portion 72 that is stationary in said housing 56 relative to the rear piece 62, whereby the lugs 68 are permitted to engage an annular groove 74 in the rear portion of the plunger (FIG. 2). A compression spring 76 tensioned between the rear side of the head 66 and a forwardly facing end surface of the lugs 68 exerts a great bias force on the plunger in the direction to the left as seen in FIG. 1.

The end 78 of the rear piece 62 has an annular, forwardly extending projection 80 comprising a cam member resting against a rearwardly diverging inner surface 82 of the rear ends of the leg portions 70.

A plug 84 is detachably mounted at the forward end of the housing 56. A central tubular element 86 extends through said end plug 84. On the inner end of the tubular element 86 there is mounted a blasting cap 88, and the outer end of the tubular member forms a connection for the end of a shock wave fuse 52, the other end of which being connected to a remotely located valve (not shown).

In the condition shown in FIG. 1, the plunger 64 is secured against release by means of a horseshoe-shaped safety means 90. After placing the trigger device 54 at a suitable location, the trigger device is unlocked by pulling out the safety means 90 through an aperture (not shown) in the housing 56.

The function of the moisture actuated trigger device according to the invention will be apparent from the description hereinafter.

The trigger device 54 is placed on a suitable spot so as to detect any presence of leaking liquid from a pipe conduit system, e.g. on the floor below a dishwasher for household use supplied with water from a pipe line in which a safety valve (not shown) is mounted. After the placement the trigger device 54 is connected to the valve by means of the shock wave fuse tube 52, whereafter the trigger device is unlocked by pulling out the safety means 90.

In case of a leakage downstream of the valve in the pipe line or in the machine connected thereto, the moisture absorbing swelling body 58 will, when the water reaches the device, collect water and thereby expand while exerting a quickly increasing pressure on the end 78 of the rear piece 62, thereby displacing the same to the left as seen in FIGS. 1 and 2. During this forward movement of the rear piece 62, the annular cam member 80 separates the ends of the leg portions 70 so that the inwardly extending lugs 68 thereof are lifted out from engagement with the annular groove 74 in the rear portion of the plunger 64 and release the same so that it is thrown forward by the tension of the spring 76 to powerfully strike the blasting cap 88 (see FIG. 2). Due to this action the blasting cap 88 will detonate and ignite the powder of the fuse 52 which thereby may immediately generate a powerful instantaneous shock wave that may act on the valve such that the valve member thereof is forced to its valve seat closing position to shut-off the water supply to the machine.

The blasting cap 88 may be replaced by an oxygen capsule or the like which may be punctured by the forwardly thrown plunger 64, whereby a gas pressure shock may be transferred to the valve through a tube replacing the fuse line 52.

The trigger device 54 may again be made usable by replacing the swelling body with a new one, whereafter the end plug 84 is removed and the plunger 64 is pushed against the action of the spring 76 until a locking engagement is established between the lugs 68 on the leg portions 70 and the groove 74 in the rear portion of the plunger 64. The movable rear piece 62 is then locked or secured by inserting the safety means 90. A new blasting cap 88 is attached to the inner end of the tube element 86, and the end plug 84 is again inserted in the housing 56. Finally, a new fuse tube 52 is connected to the outer end of the tubular element 86 of the trigger device and to the valve (not shown). When the trigger device 54 has been located at a proper spot and been unlocked, it is again ready to be used together with the remotely located safety valve.

The invention is not limited to the embodiment described above with reference to the drawings, but could be varied within the scope of the following claims.

What I claim is:

1. A moisture actuated trigger device comprising a housing; a moisture absorbing swelling body inserted through an opening in said housing, one end of said body engaging a stationary wall member of said housing and the opposite end engaging an end wall of a sleeve slidable within said housing upon expansion of the swelling body; an elongated plunger member in said housing movable between a first, stand-by position and a second, released position; latch means detachably engaging said plunger member for holding it in its first, stand-by position; spring means biasing said plunger member in a direction towards its released position; cam means on said sleeve for disengaging the latch means from the plunger member thereby enabling the latter to rapidly move from its first, stand-by position to its second, released position; and a shock wave initiating means located in the path of travel of said plunger member.

2. A device according to claim 1, characterized in that said housing having an elongated configuration and that the swelling body receiving opening is located at one end of the housing while the shock wave initiating means is located at the other end of the housing and connected to an external fuse fitting.

3. A device according to claim 1 or 2, characterized in that said shock wave initiating means consists of a blasting cap.

4. A device according to claim 1 or 2, characterized in that said shock wave initiating means consists of an oxygen capsule.

5. A device according to claim 1, characterized in that said swelling body comprises folded paper material.

* * * * *